US008710955B2

(12) United States Patent
Teti et al.

(10) Patent No.: US 8,710,955 B2
(45) Date of Patent: Apr. 29, 2014

(54) AUTOMATED GATE SYSTEM

(75) Inventors: Fabio Teti, Waxhaw, NC (US); Chad Michael Hewitt, Lisle, IL (US)

(73) Assignee: Remprex LLC, Woodridge, IL (US)

( * ) Notice: Subject to any disclaimer, the term of this patent is extended or adjusted under 35 U.S.C. 154(b) by 378 days.

(21) Appl. No.: 13/325,837

(22) Filed: Dec. 14, 2011

(65) Prior Publication Data

US 2012/0146763 A1 Jun. 14, 2012

Related U.S. Application Data

(60) Provisional application No. 61/422,916, filed on Dec. 14, 2010.

(51) Int. Cl.
*G08B 29/00* (2006.01)

(52) U.S. Cl.
USPC ..... 340/5.7; 340/5.1; 340/5.5; 340/908.1; 340/928; 340/932.2; 187/313; 187/335; 701/117

(58) Field of Classification Search
CPC ..... G08C 2201/91; G08G 1/09; G08G 1/142; G08G 1/017; G08G 1/096775; G08G 1/14; G08G 1/146; G08G 1/147; G08G 5/065; G08G 1/202; G08G 5/0082; G05B 2219/24162; G07C 9/00007; G07C 9/00; G07C 9/00126; G07C 9/00166; B66B 13/143; B66B 13/12; B66B 13/26; B66B 13/16; B66B 13/165; B66B 1/468; G08B 29/00
USPC ..... 340/5.1–5.92, 901–944; 701/117; 187/313–335
See application file for complete search history.

(56) References Cited

U.S. PATENT DOCUMENTS 6,958,676 B1 * 10/2005 Morgan et al. ..... 340/5.72
7,119,674 B2 * 10/2006 Sefton ..... 340/521

* cited by examiner

*Primary Examiner* — George Bugg
*Assistant Examiner* — Sharmin Akhter
(74) *Attorney, Agent, or Firm* — Shumaker, Loop & Kendrick, LLP

(57) ABSTRACT

An automated gate system (AGS) for processing vehicles entering and exiting a controlled access facility via a single common traffic flow. The AGS provides a single portal receiving both ingress and egress vehicle traffic as a common traffic flow sharing a same access road. The access road feeds a multi-lane gated sub-system having associated kiosks providing an interface for obtaining vehicle and driver related information and which have a combined inbound/outbound gate for controlling ingress and egress movement of vehicles of the common traffic flow in and out from the controlled access facility. A computer system receives signals from the portal and the kiosks representing a status of the vehicles alone or in combination with driver information for controlling gate operation of each of the gates. Thereby, both ingress and egress routes are controlled, and both ingress and egress movement of the vehicles regarding the access facility is controlled.

21 Claims, 7 Drawing Sheets

AUTOMATED GATE SYSTEM

CROSS-REFERENCE TO RELATED APPLICATION

This application claims priority under 35 U.S.C. §119(e) of U.S. Provisional Patent Application Ser. No. 61/422,916, filed Dec. 14, 2010, the disclosure of which is hereby incorporated by reference in its entirety.

BACKGROUND

The present invention generally relates to automated gating systems (AGS) and methods thereof which automate vehicle ingress and egress to and from a controlled access facility, and more particularly, relates to a unified gate layout, system and method for controlling a vehicle's access to a controlled access facility.

Referring to FIG. 1, a conventional automated gate system/layout 10 is shown. The conventional AGS 10 is of the type employed for allowing multi-wheel cargo vehicle access to cargo drop-off points and cargo pick-up points within a controlled access facility 99 (which may also be referred to as a restricted area or restricted facility), for example, airport, seaport, railroad yards, container yards, truck depots, etc., e.g., having truck loading/unloading zones. In the conventional AGS system operatively configured for the conventional layout shown in FIG. 1, two discrete and separate traffic flows are depicted referred to herein as inbound gate layout 15 and outbound gate layout 20. The layouts shown in FIGS. 1 and 2 are not shown or limited to any particular scale and distances between entry, exit, processing points may range from between hundreds of feet to miles, and the controlled access facility or restricted area 99 may range from tens up to hundreds of acres.

Conventional Inbound Gate Layout

In the inbound layout 15 the AGS operates to control processing or flow of vehicles, e.g., multi-wheeled cargo vehicles or "rigs" 12, from a public street (e.g., a highway) 25, across a first access way, e.g., an inbound lane 26, to an entry point where the vehicle is received and passed through an inbound camera portal 40 that the trucks pass through within which photo imagery of the vehicle and tire scan, is obtained and processed. At the portal 40 is situated high-resolution cameras and imaging devices for taking high-resolution images of the complete vehicle yielding information including unit numbers, obtaining license plate numbers, obtaining equipment and tire scans, etc.

It should be understood that, besides photos, portals 40 can be equipped with video cameras to take video. Also, to clarify, photos include images of the truck and the equipment (e.g. container, chassis, tires, genset, seals, hazmat decals, etc.). Portals can also be used to read RFID (radio frequency identification) tags on a truck (e.g., EzPass), on a container, on a chassis, on a seal, etc., or to scan cargo (using backscatter/gamma apparatus, for example), and sometimes to read scale weights (usually only applicable for in-motion scale weighing systems). Further, it should be further understood that while most railroad yards do employ portals, an AGS deployment doesn't necessarily require portals.

Continuing in FIG. 1, after processing, via a further stretch of inbound traffic lane 28, the vehicle approaches a designated gate lane or any lane of among several inbound gate lanes 45*a*, 45*b*, 45*c*, 45*d*, wherein each lane has an associated AGS kiosk, such as inbound kiosk(s) 45, with which the vehicle driver interacts with to facilitate their inbound movement. The hardware employed at a kiosk varies by installation/client/industry/etc., but typically, at each inbound kiosk, processing includes manually performing functions such as obtaining driver information/verify driver ID including, but not limited to, obtaining biometric information (finger prints, retinal scans, etc).

Typically, in one example, a driver pulls up to a kiosk (which is usually equipped with a touchscreen and/or keyboard) and identifies himself/herself by fingerprint readers (if present), card readers such as Transportation Workers Identification Card (TWIC) readers, proximity readers provided by Port Authority or facility operator, etc. (if present), a driver code (and sometimes a PIN code). Once identified, the driver is asked a series of questions that allow the system to check if the driver is performing a gate mission(s): e.g., picking up an available unit, or dropping off a valid unit. The kiosk may also check if the driver is able/allowed to pick up and/or drop off a unit.

The kiosk communicates information or feedback to the driver pertaining to what is trying to be accomplished (e.g., "There is a problem, please proceed to driver's assistance area for resolution", or "Please pick up UNIT XYZU123456 at yard location XYZ", etc.). If the driver has a question or problem, the call button can be pressed, which is connected to an AGS clerk. In one example, the clerk can see the driver via a pinhole camera in the kiosk, and also see the unit from a rear-mounted camera, may be able to zoom-in to ensure that unit is empty or to review and take a photo of the seal, etc.) The driver is able to communicate with the clerk via the kiosk speaker/microphone or a handset on the kiosk. Generally at completion of the communication between the driver and the kiosk and the clerk, a ticket is printed and the gate arm raised to allow the driver to proceed. Alternative embodiments may include a facility where an interactive screen display is not available, and a kiosk includes a telephone or intercom and ticket printer (and may include a video camera). At the inbound kiosks, several vehicles may queue in respective gated lanes awaiting gated access to a restricted yard or facility 99, e.g., a contained area having one or more cargo drop-off and/or cargo pick-up points at one or more locations there within.

An AGS employed to control operation of the inbound gates 46 may be programmed to control vehicles throughput at each inbound kiosk at each lane 45*a*, 45*b*, 45*c*, 45*d*, e.g., by raising and lowering a gate to control vehicle access to the yard, e.g., via a yard entry access way (e.g., lane/road) 22. For example, upon a ticket being printed and presented to a driver, the gate arms are raised. However, if the kiosk detects an exception to a driver, the exception handling logic (employed at the gate and invoked by, e.g., a computer system and software program) prevails over normal operation and the gate is not raised.

Particularly, gate open and shut operations at each kiosk 45 are coordinated such that a single vehicle is permitted access within a pre-determined time, i.e., only one gate opens/shuts at an inbound kiosk, at a time. There may be implemented other automated gate control algorithms (e.g., FIFO, round-robin control method, e.g., based on amount of vehicles waiting and their distribution amongst lanes) implemented for controlling this single vehicle access at a time.

However, more typically (in the traditional portal scenario), a free-flow pattern is used. A free-flow pattern is similar to a Toll booth, i.e. all gate arms are opened or closed whenever each driver has completed his/her turn. The only time this may be stopped is when one of the drivers has an exception at the outbound gate kiosks and needs to return to the yard (i.e., not allowed to leave); at that point, the exit arm is closed and the RTY arm is raised. It is understood that these gate control operations may optionally be manually overridden in case of security breach or technical or hardware failure, for example.

Conventional Outbound Gate Layout

Referring to FIG. 1, in a similar manner to the inbound gate system, in the outbound gate layout 20, the AGS operates to control processing or flow of the vehicles, e.g., multi-wheeled cargo vehicles, from the restricted access yard or facility 99 via exit lane/road 32 back to the public street 25. In the vehicles exit traversal, the vehicle is first received at an outbound portal 50 where the vehicle is processed. Typical processing performed at the outbound portal 50 includes automated functions such as vehicle ID, tire scanning and other processing as described with respect to the inbound gate layout 15 of FIG. 1.

After processing the vehicle at the outbound portal, and the vehicle traverses a further stretch of an outbound lane 38, the vehicle 12 approaches a designated lane or any lane of among several gated lanes 55*a*, 55*b*, 55*c*, 55*d* having an associated gate 56 at an outbound kiosk 55, at which the vehicle driver interacts to facilitate the vehicles exit. At each outbound kiosk 55, typical processing includes performing functions such as: obtain/verify driver ID including, but not limited to, obtaining biometric information (finger prints, retinal scans, etc), obtain/verify cargo type and amount, and obtain/verify any other authorizations/licenses required to carry such cargo. This is performed manually at the kiosk, e.g., performed via graphic display interfaces accessible to the truck drivers at each outbound kiosk 55.

At outbound kiosks 55, there is performed similar processing as in the inbound kiosks 45, however, one difference may include that at the gate outbound kiosks 55, the driver doesn't need to identify themselves, as the ticket the driver was given at the inbound kiosks contain barcodes for identification. In a traditional gate scenario, outbound kiosks are usually equipped with barcode readers (used to read the ticket number). This barcode identifies the driver and the visit/missions the driver is completing. If the bar code is valid, information is known and confirmed from reading the bar code, and the gate exit time is consequently much faster than at the entry kiosks 45.

At the outbound kiosks 55, several vehicles may accumulate and queue in respective gated lanes 55*a*-55*d* awaiting gated egress to the public street 25. The AGS 10 is employed to control operation of the outbound layout gates 56, which operate at each outbound kiosk to control vehicle exit flow, e.g., gate raising and lowering, in a controlled or automated fashion. Thereby, the AGS controls vehicle egress back to the public street 25, e.g., via a separate access way (e.g., stretch of lane/road) 27 as shown in FIG. 1. Truck vehicles moving through the outbound gates 56 are further restricted upon passing through the gate lanes by means of gate arm(s) 60 that can allow egress from the facility and onto public streets, or gate arms 65 that can direct the truck to return to the facility or yard 99, thus preventing the unauthorized movement of a vehicle from the facility.

Referring to FIG. 2 which depicts greater detail the outbound kiosk, the exit gate layout there is included further gate(s) 60 implemented and controlled by AGS 10 to enable separate vehicle egress to the public street along the separate exit path 27 (shown in FIG. 1). These operations may optionally be manually overridden in case of security breach or technical or hardware failure, for example. Particularly, AGS gate open and shut operations at each outbound kiosk are coordinated such that only a single vehicle is permitted outbound egress within a pre-determined time, i.e., only one gate opens/shuts at an inbound kiosk, at a time, which is the same as inbound flow with the exception of "exception handling", i.e., when a driver is NOT allowed to leave, designated as an "exception", all gate arms remain closed, after the last truck in the security zone has exited, the exit arm is lowered, the RTY arm is raised, the gate arm for the driver with the exception is raised, and the driver is allowed to proceed to RTY, after the driver clears the RTY gate arm, the RTY gate arm is lowered, the exit gate arm is closed, and operation returns to normal. There may be implemented other gate (queue) control algorithms (e.g., FIFO, round-robin control method, e.g., based on amount of vehicles waiting and their distribution amongst lanes) implemented for controlling this single vehicle egress.

Further as shown in the detailed view of FIG. 2, gate 65 is implemented and controlled by AGS 10 to enable single vehicle return to the yard via access street/lane 67, for example, if the vehicle had mistakenly picked-up wrong cargo or for any reason had to return to a pick-up or drop-off point. Once returned to the yard 99, a vehicle must egress via the aforementioned outbound gate layout 20.

Current AGS Exit Control System

The operation and process flow of a conventional AGS Exit Control System (ECS) as currently employed at the exit gate (s) 60 at outbound layout 20 (of FIG. 1) is now described in greater detail with respect to FIG. 2. For example, in the exit gate layout of FIG. 2, the system ECS operates in conjunction with various barriers 70 configured to define a security zone 75 within which only one vehicle is allowed through at a time (e.g., only when running in that mode; usually, these operate in free-flow fashion). As shown, there are four exit gate lanes 55*a*-55*d* and one exit Bobtail lane 55*e* ("Bobtail" is an industry term used to describe a truck that is not hauling any equipment, i.e., a cab without any container/chassis or trailer behind it). The exit Bobtail Lane 55*e* has additionally, in-lane, loops for bobtail detection.

In current implementations, extra loops are added to any or all lanes, or other ways of detecting bobtails can be added if desired. Often times, facilities don't want to slow down bobtails since there is no verification of equipment necessary. For that reason, if the system knows that a truck at a kiosk is a bobtail, then the kiosk screen flow is changed (i.e., less information is required) and the overall time at the kiosk is reduced. This identification of a bobtail in the lane is usually accomplished in two or three ways, ground loops set back from the kiosk (far enough not to be triggered by the rear tires of the truck), sonic (or other types) of sensors set back from the kiosk, or dividers/barriers (usually concrete, sometimes called "k-rail" dividers) placed in such a way that ensures that only trucks without equipment could navigate the lane (usually in an "S" pattern).

Loops are also referred to as ground loops (e.g., coiled wire embedded into the ground), which may be similar to the ground loops used at traffic lights, they are wires formed in squares (or loops) that detect presence of metal (usually vehicles) directly above them. Typically, the loops is implemented by introducing a small current to the loop thereby creating a magnetic field directly above it, thus, when a vehicle (having metal) crosses this field, the change is detected (usually by loop detectors), and a signal is generated indicating the presence of a vehicle.

The safety zone 75 delineated by barriers provides only a single way out of the safety zone 75, either via the exit gate 60, or the bypass lane gate 65. In one embodiment, the barriers 70 may be used to control velocity of trucks, e.g., deploying a serpentine pattern of barriers to slow the exiting trucks to 15 MPH.

The bypass lane 67 allows exiting traffic to return to the yard when an exception occurs at the exit lane, i.e., the bypass lane is located within the safety zone 75 and is needed to ensure that a transaction causing an exception can be routed back into the yard for resolution. If a truck driver picks up the wrong container, for example, the bypass lane allows the truck driver to return to the yard to correct the mistake. For example, a transaction that generates an exception is a transaction where the driver, is trying to exit with a unit that the vehicle is not supposed to be hauling, or a driver that didn't clear a hold on a container (e.g., charges, customs, etc.), or a driver that failed to register as a valid driver, etc.

As shown in FIG. 2, two sensor loops 80*a*, 80*b* are employed at the bypass lane. This allows the proper detection of traffic as it clears the arm 66 of the bypass lane 65 and ensures the proper direction of the vehicle. Sensor loop 80*a* is used to signal when a truck is exiting through the bypass lane 67. This loop is necessary to ensure that traffic outside the barrier does not cause the arm 66 to close prematurely.

At exit gate 60 there is employed AGS 10 controlled gate arm 61 and a final, pop-up barrier 64. In certain facilities, additional vehicle barrier devices may be installed, for example, bollards, anti-ramming barriers, and other "pop-up" barrier systems.

In one implementation, an AGS Exit Control Module 98 controls the gate arms at the exit lanes to ensure that only one truck enters the Safety Zone 75 at any given time. It should be understood that control module 98 represents the application/software that controls the exit logic including perhaps, the logic used when using the single-truck security mode. The control module 98 may include a computer having a program, which may be part of a central computer and/or communicating with other control modules.

As further shown in FIG. 2, the exit gate 60 is the final barrier between the safety zone 75 and the final barrier 64, if present. Gate arm 61 is raised under control of the AGS exit control module 98 when a transaction is completed at the outbound lane complex, and serves as a positive indication to the truck driver that they are clear to exit.

In a typical AGS configuration, the exit lane gate arm 61 stays open until either a bypass is required, in which case it closes until the truck enters the yard clearing the safety zone, or when an outbound lane has an alarm, which is caused by a truck crashing the outbound gate. The bypass is controlled by the status of the visit in the lane for which the truck is currently exiting.

In manual mode the exit lane gate arm 61 can be opened or closed, the outbound gate lanes can open at any time, and the bypass gate arm 66 can also be opened and closed. It is important to note, however, that the exit and bypass arms 61, 66 will treat an OPEN command as a KEEP OPEN command. An OPEN command at any kiosk lane causes the arm to open for one truck, but at these special lanes, the OPEN command causes the arm to stay open until a CLOSE command is received.

Current AGS Flow Control

Current AGS Flow Control describes the flow of traffic by truck drivers through the inbound and outbound gates for entering or exiting a facility. For example, in the case of a truck driver entering the facility, the AGS gate flow could be described as follows: Vehicle/Truck driver enters the facility; Vehicle/Truck driver drives through the inbound portal; Vehicle/Truck driver approaches inbound kiosks; Vehicle/Truck driver interacts with the kiosk and takes the gate receipt; gate arm in that lane is raised; and Vehicle/Truck driver enters the facility/yard.

In the case of a truck driver exiting the facility, a typical AGS Flow Control is as follows: Vehicle/Truck driver approaches outbound portal; Vehicle/Truck driver drives through outbound portal; Vehicle/Truck driver approaches outbound kiosks; Vehicle/Truck driver interacts with the kiosk. If truck driver is able to leave facility/yard (i.e., no problems), then a gate arm in that lane is raised and truck driver exits to street.

If truck driver is not able to leave facility, the gate arm 61 at the exit to street point is lowered, all other outbound gate arms are maintained closed, the gate arm 65 at the return to yard point 67 is opened, the gate arm for that truck driver is raised and the truck driver drives back into the yard 99.

From the foregoing, it is apparent that current AGS operation for dual convention gate layout, allows a free-flow of traffic into the facility 10 via inbound layout 15 for inbound drivers, and a separate free-flow of traffic out of the facility via outbound layout 20 for outbound drivers. This is at the expense of requiring expansive areas and additional inbound/outbound processing equipment cost/maintenance. That is, in the traditional layout, there are extensive costs associated with the AGS system, for example, cumulative lanes of traffic for both inbound and outbound gate layouts, equipment, portal structures, asphalt areas, striping, concrete barriers, wiring, electrical demands, real estate/area, concrete pads, concrete floors, etc. and the added cost to maintain these additional items.

Further, when an exception occurs at the outbound-gates, the driver is forced to return into the yard (usually to driver's assistance, e.g., by returning to an area or building 11 designated for driver to go when they have questions or problems.) When an exception occurs (to correct the problem), typically the ECS 200 automatically (using software control) stops all other drivers at the gate stands, closing the gate arm at the facility exit point, and opening a gate arm at the Return To Yard point.

SUMMARY

There is provided an automated gate systems (AGS) for a unified gate layout comprising a single portal receiving and processing vehicles comprising ingress and egress traffic as a common traffic flow sharing a same access road. The single portal obtains and processes information relating to vehicles passing therethrough whether entering or exiting a controlled access facility. The same access road feeds a common multi-lane gated sub-system, each lane having an associated kiosk providing interface for obtaining vehicles and driver related information and each of the kiosks. Each single kiosk has a combined inbound/outbound gate for controlling ingress and egress movement of vehicles of the common traffic flow into or out of the controlled access facility. A computer system receives signals from the portal and the kiosks, and the signals represent a status of the vehicles alone or in combination with driver information, and the computer system processes the signals to control operations of one or more gates controlling ingress and egress routes for the controlled access facility as a common traffic flow sharing a same access road. The computer system includes a program embodied on a non-transitory computer storage medium for controlling gate operation of each of the gates and thereby controls both ingress and egress routes and controls both ingress and egress movement of the vehicles to and from the controlled access facility as a common traffic flow sharing a same access road. Thereby, the computer system receives information from the single portal and controls the gate operations of each of the gates in the multi-lane gated sub-system. The AGS system is able to retrieve current and prior transaction status of any given user to ensure the user has ingress and egress, in that order. For example, if the user has an issue while entering (ingressing), the user cannot exit (egress) without operator override or resolving the issue. Similarly, if the user enters the facility (ingresses), and then has an issue exiting (egressing), the user returns to the facility for assistance to exit wither by operator override or by resolving the issue. When the user once again seeks to enter the facility, the user cannot enter without either operator override, or previously having resolved the issue.

BRIEF DESCRIPTION OF THE DRAWINGS

These and other objects, features and advantages of the present invention will become apparent from the following detailed description of illustrative embodiments thereof, which is to be read in connection with the accompanying drawings. The various features of the drawings are not to scale as the illustrations are for clarity in facilitating one skilled in the art in understanding the invention in conjunction with the detailed description. In the drawings.

DETAILED DESCRIPTION

Figure 1:
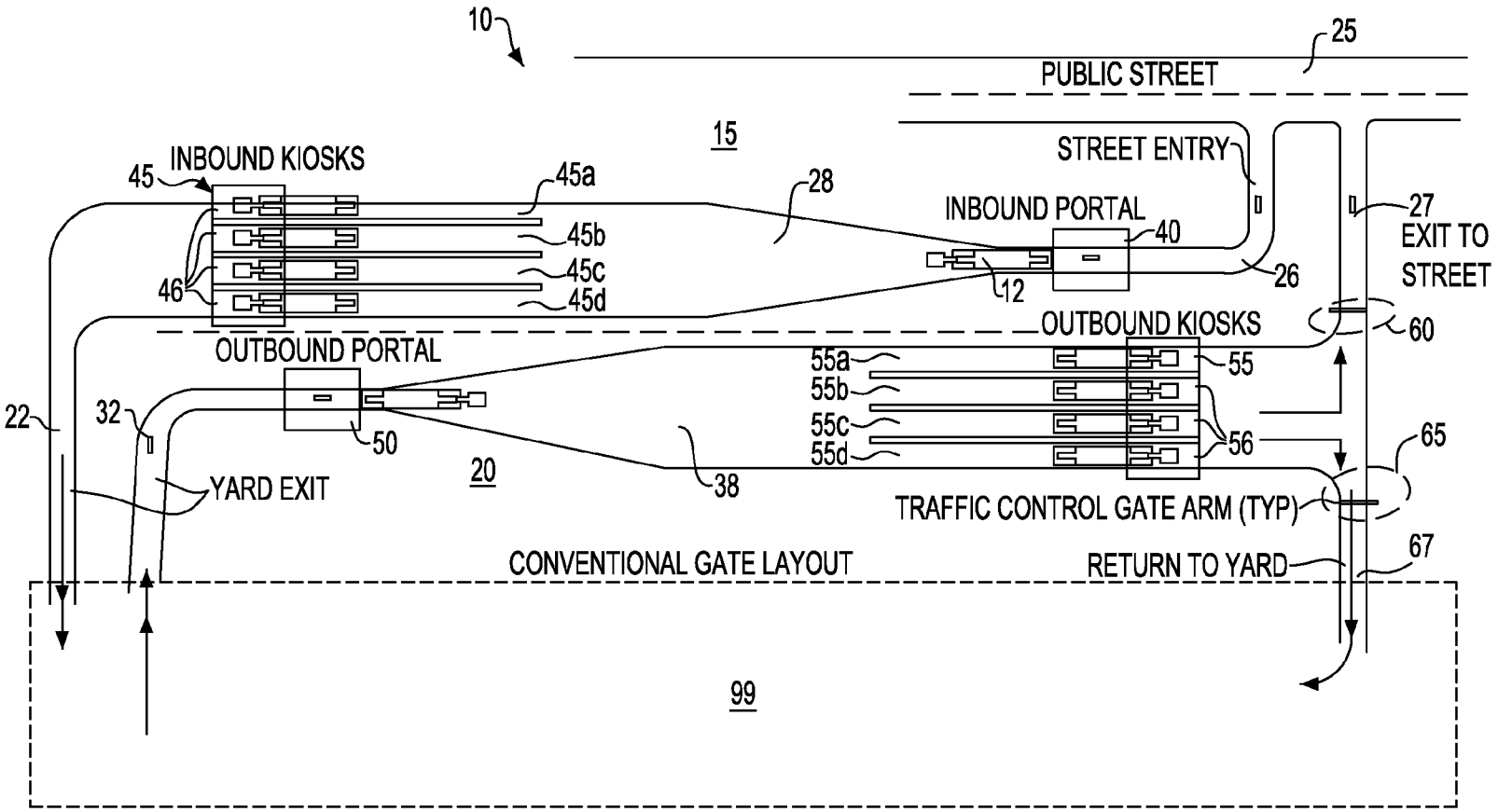
FIG. 1 (PRIOR ART)
FIG. 1 is a schematic diagram depicting a prior art gate layout system.
Figure 2:
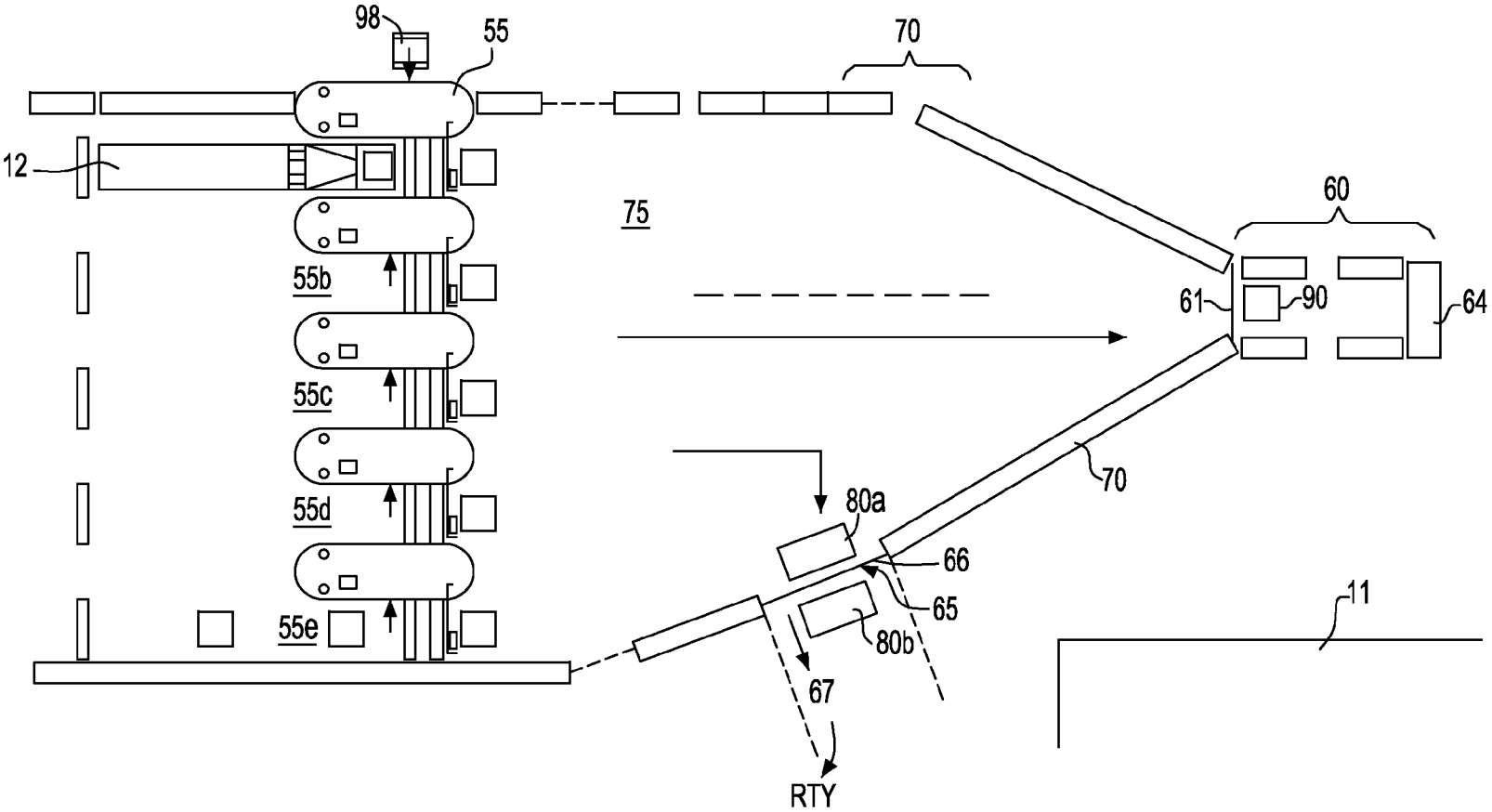
FIG. 2 (PRIOR ART)
FIG. 2 is a detailed schematic diagram of a prior art outbound kiosk of the gate layout system shown in FIG. 1.
Figure 3:
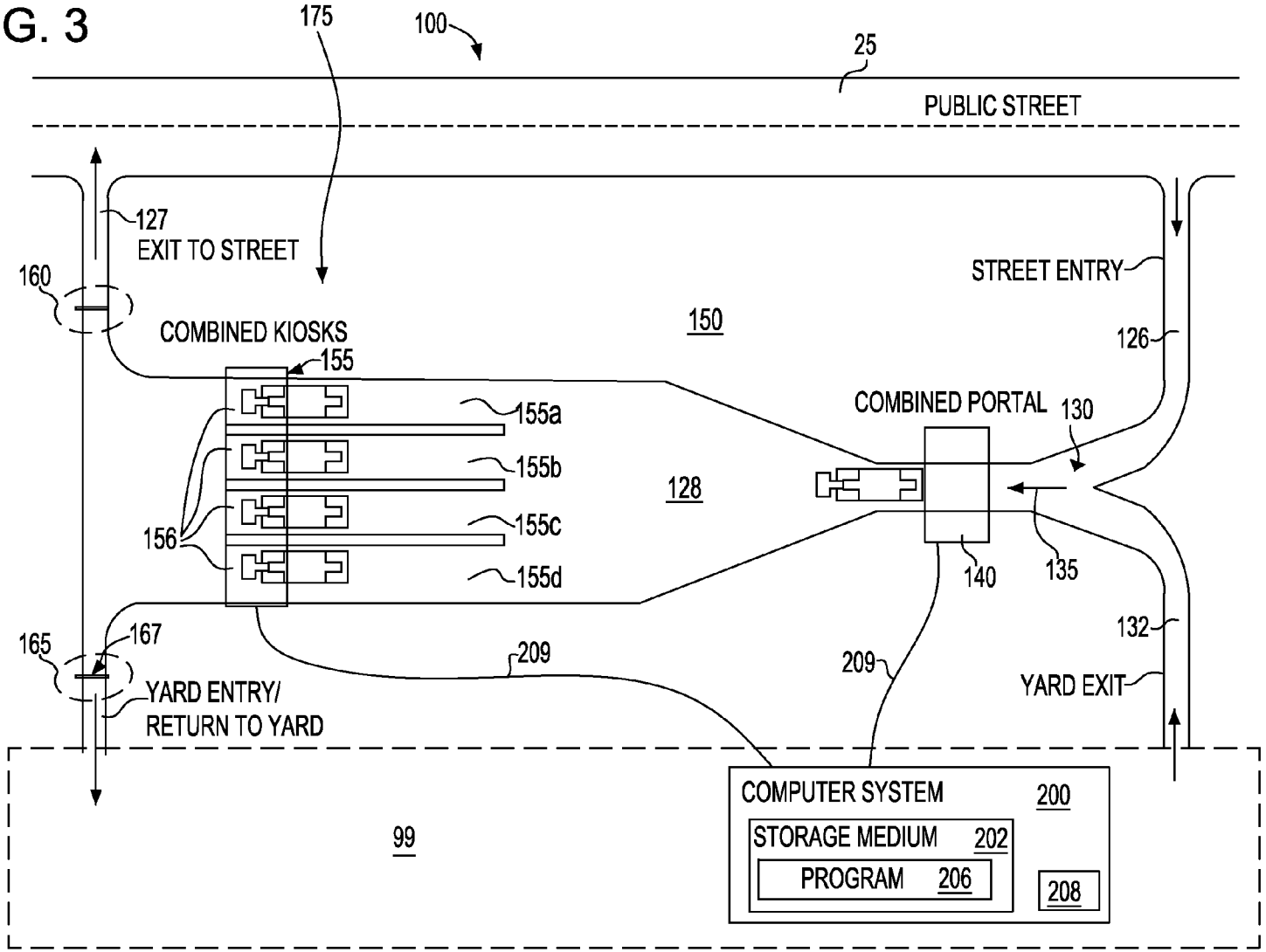
FIG. 3 is a schematic diagram of a unified gate system according to an embodiment of the invention.

Referring to FIG. 3, in one embodiment of the invention, there is provided an automatic gate system (AGS) 100 for a unified gate layout of a controlled vehicle access facility. The AGS 100 may also be referred to as a unified AGS system or facility, or simply the facility 100. The AGS system controls access to a secure area 99 and employs a single portal for obtaining and processing information relating to vehicles comprising ingress and egress traffic as a common traffic flow sharing a same access road.

In contrast to the prior art systems, software and processes are provided in the AGS 100 portal and kiosk stations to accommodate any vehicle (e.g., a multi-axle truck) driving through the portal that is entering or exiting the facility via a same access road.

The AGS 100 includes a unified gate layout 150, as shown in FIG. 3, wherein all combined kiosks include hardware, software and user interfaces to accommodate all vehicle traffic whether entering and exiting the facility 100 regardless of their gate missions. For example, a kiosk provides user interface display screens to indicate to a vehicle driver to provide information for entering or leaving the facility, for example, scanning a ticket or placing their finger on the biometrics reader.

FIG. 3 depicts the facility 100 having a unified gate layout 150 according to one embodiment of the invention. The unified gate layout 150 incorporates a combined, i.e., "Bi-Directional" Portal 140. Further provided is a corresponding AGS workflow(s) for the AGS gates when Bi-Directional Portal 140 is used.

In the unified layout 150 shown in FIG. 3, ingress traffic (e.g., double- or multi-axle wheeled vehicles or "rigs" or "units") enters the facility 100 via access way 126, e.g., which may be off of a public street 25. Egress traffic for vehicles exiting the facility 100 is via respective outbound yard exit lane 132 merged with the access way 126 into one common traffic stream along a common access way 130 and common access way 128 when leaving portal 140. Thus, both ingress and egress traffic are processed at the common Bi-Directional Portal 140 in a same direction representing a common traffic flow 135.

Figure 4:
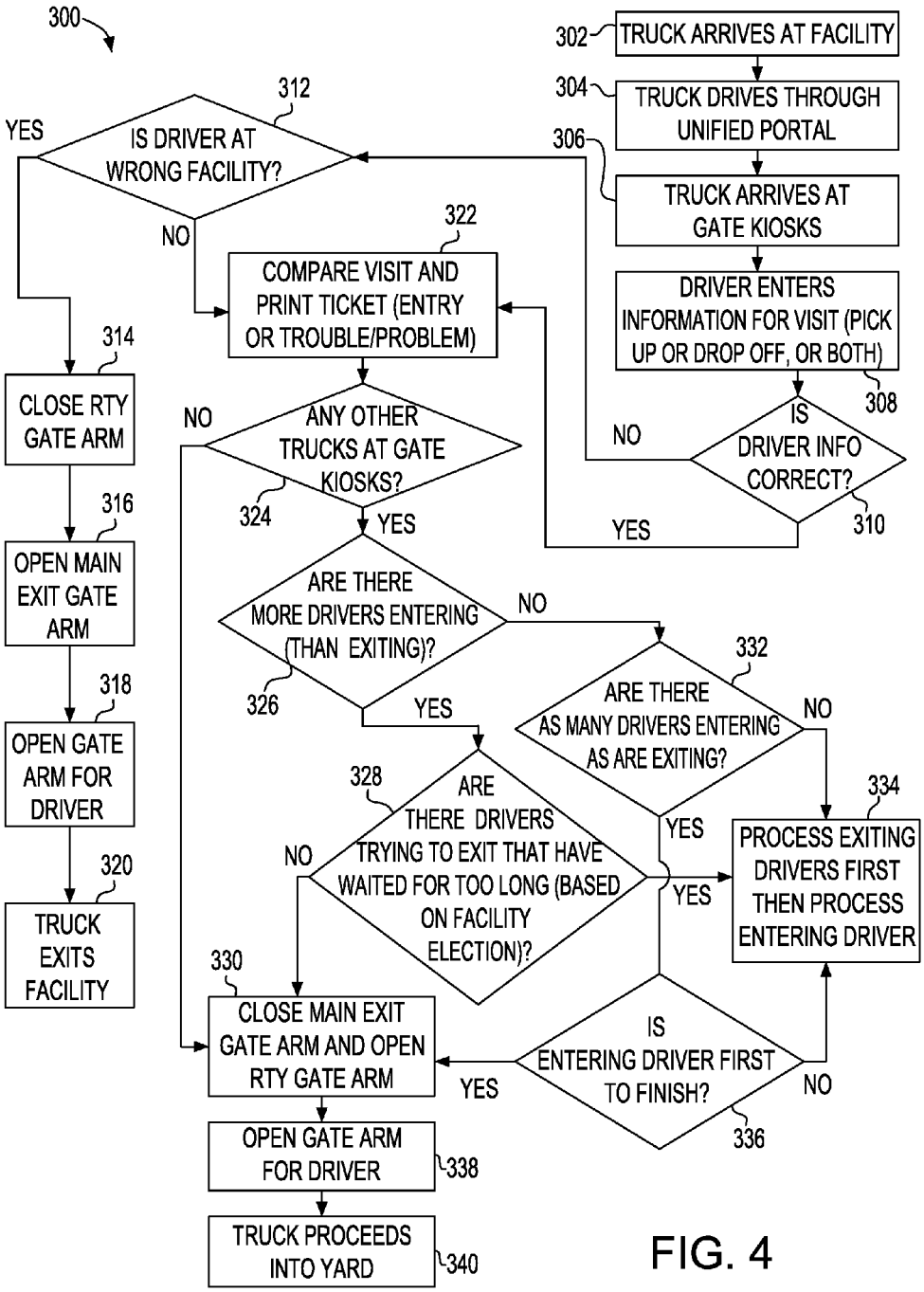
FIG. 4 is a flow chart depicting a method according to an embodiment of the invention directed to a vehicle arriving at a facility conforming with the unified gate system shown in FIG. 3.

Programmed logic for controlling gate operations at a processor or computer device at the Bi-Directional portal 140 in the unified layout 150 is described in detail herein with respect to FIG. 4 which shows the logic implemented for enabling vehicles to enter the facility 100 via Bi-Directional portal 140. The programmed logic may be a software program. A control system 200 may include a computer 202 having a program 204 embodied on a non-transitory computer readable storage medium 206 for execution by a processor 210. The ECS 200 may further include a communication connection 208, for example, a network module, either wireless or wired, or include a direct wired link to kiosks and the single portal which require communication with the ECS 200, such communication being generically shown as connections 209 in FIG. 3.

Figure 6:
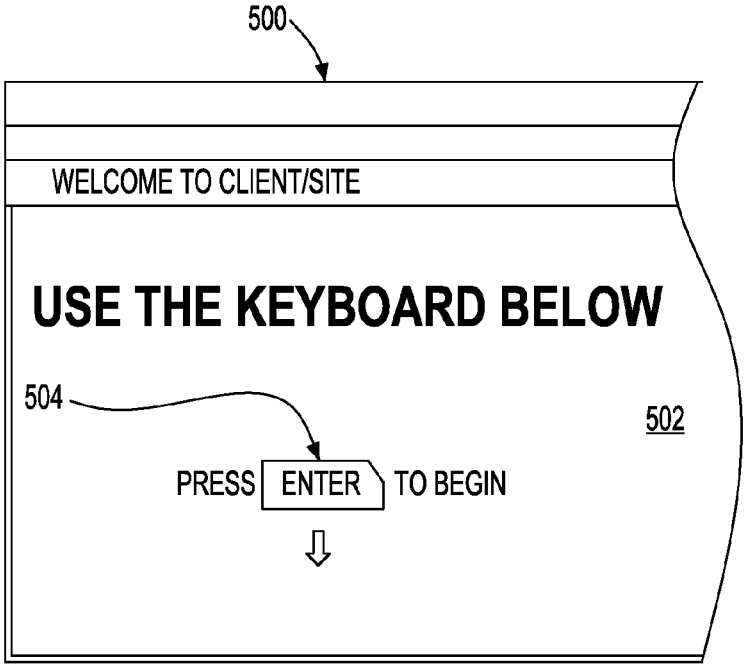
FIG. 6 is an illustration of a sample touch screen or display at a kiosk of the unified gate system according to an embodiment of the invention, which depicts a start process button.
Figure 7:
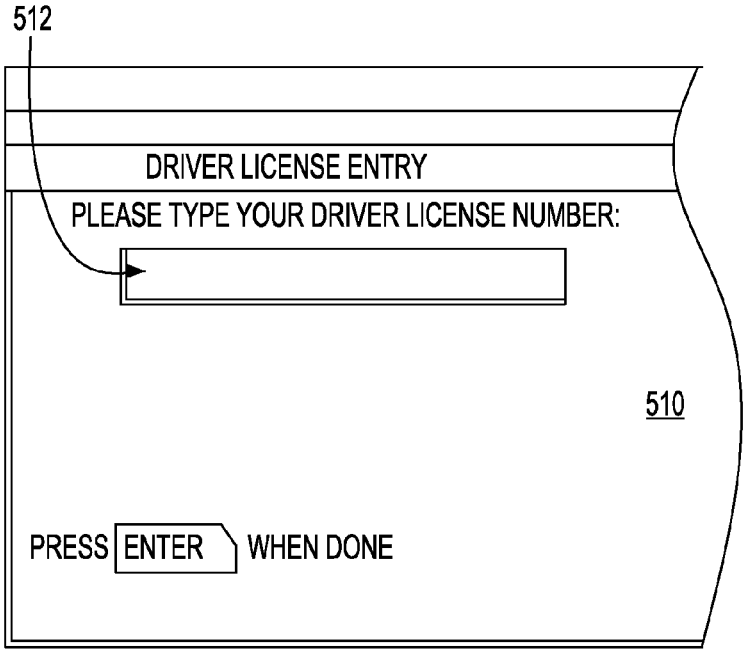
FIG. 7 is an illustration of the sample touch screen of FIG. 6 displaying a text box for a driver license number.
Figure 8:
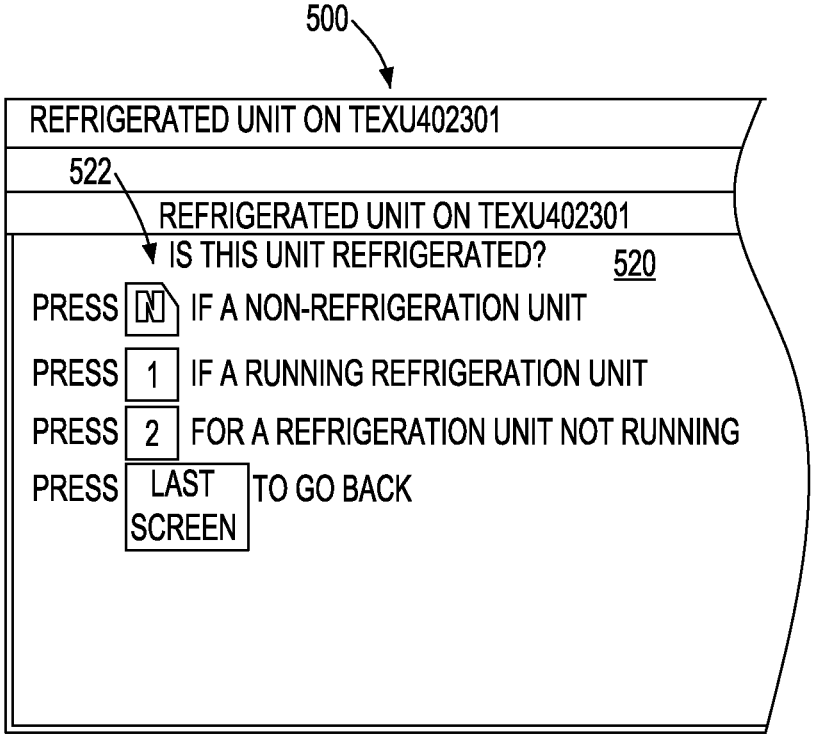
FIG. 8 is an illustration of the sample touch screen of FIGS. 6 and 7 displaying a list of selection choices.

In the unified layout 150, a vehicle passes through the portal 140 and via access way 128 accommodating a common traffic flow, vehicles are then processed at one of several gated lanes, e.g., lanes 155*a*, 155*b*, 155*c*, 155*d*, for example, which lanes include an associated combined kiosk 155, and the processing occurring at combined kiosks 155 is indifferent to the movement of the traffic, i.e., either inbound or outbound. For example, at each kiosk 155 at a gate lane 155*a*-155*d*, processing of either ingress (inbound) or egress (outbound) vehicle traffic occurs. The processing includes providing an interface enabling generation and presentation of a series of screens that provide instructions to enable a vehicle driver to enter data for collection and processing by the various authorization/verification systems employed. Sample screens are shown in FIGS. 6-8. It is understood that the screen flow is governed by the AGS "business rules" that apply for a client/site/visit type/mission type, etc. When the last screen is reached successfully (i.e., proper vehicle driver/carge authentication or verification provided and no errors are encountered), the vehicle is allowed to proceed. For example, FIG. 6 depicts a display 500 with screen 502 showing an enter button 504 to begin facility entry or exit process beginning with driver authentication. FIG. 7 illustrates a subsequent screen 510 having a text box 512 for entering a driver's license number. FIG. 8 illustrates the display 500 having a screen 520 displaying selection buttons 522 for indicating, for example, whether the truck has a refrigeration unit, and if so, what type of refrigeration unit in the truck. Other exemplary screens can instruct the user (driver) to take a ticket or to scan a ticket.

The subsequent control of traffic movement into or from the facility 100 is then controlled via gate arms 156 that direct the trucks in the appropriate direction (depending on gate area designation). For example, AGS controls gate arms 156 allowing vehicle egress back to the street 25 via access lane/road 127 for exit from the facility, or allowing entry back into the facility via a return to yard access/road 167 and prevent the unauthorized movement of a vehicle from the facility.

It is understood that the unified gate layout shown in FIG. 3 is not shown or limited to any particular scale and distances between entry, exit, processing points may range from between hundreds of feet to miles, and the controlled access facility or restricted area 99 may range from tens up to hundreds of acres.

Figure 5:
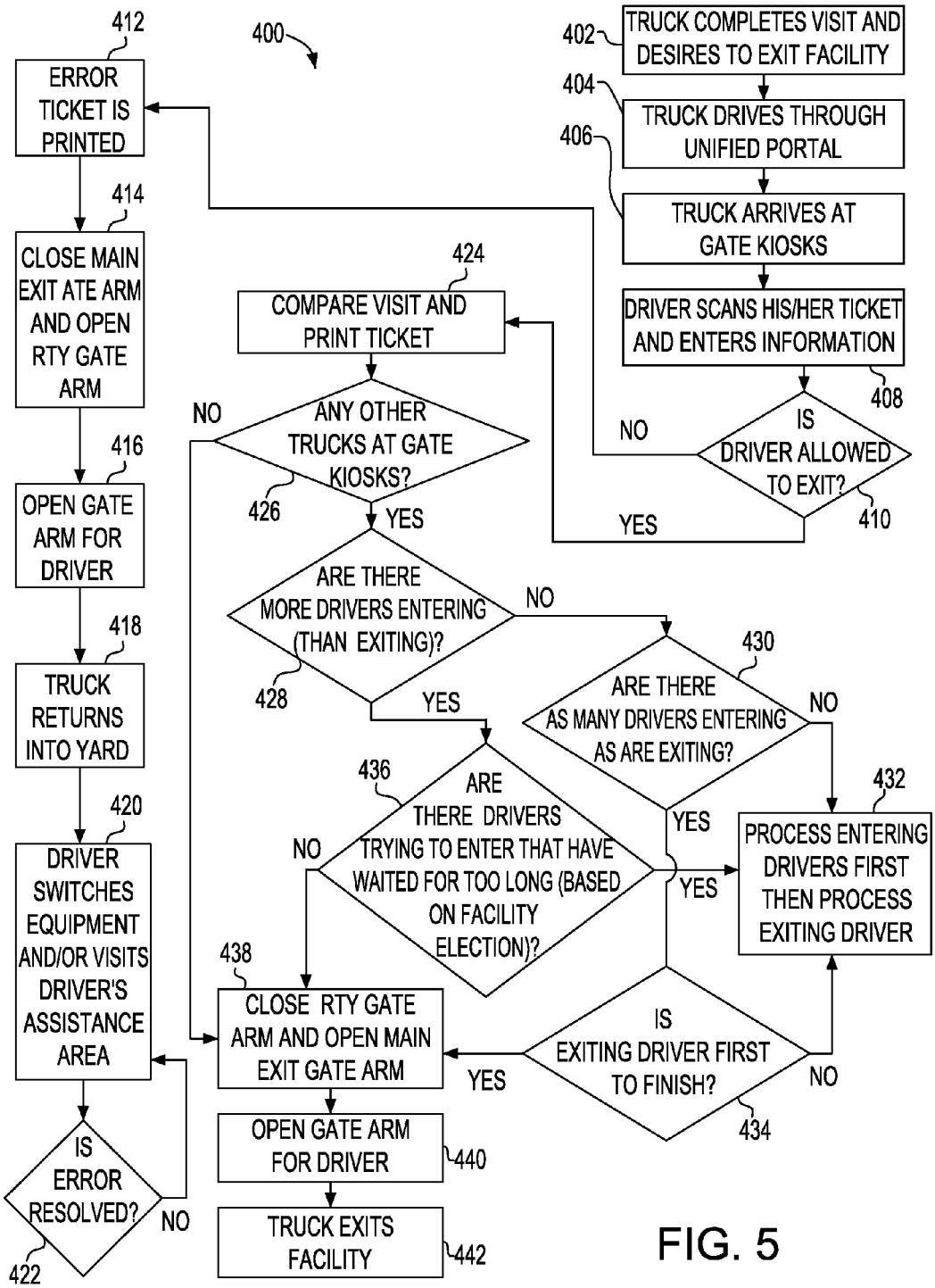
FIG. 5 is a flow chart depicting a method according to an embodiment of the invention directed to a vehicle exiting a facility conforming with the unified gate system shown in FIG. 3.

Programmed logic for controlling gate operations at a processor or computer device at the combined kiosks 155 in the unified layout 150 is described in detail herein with respect to FIG. 5 which shows the logic implemented for enabling vehicles to exit the facility 100 via combined kiosks/gates 155.

Further, depending upon the distances between vehicle processing points, e.g., BI-Di portal 140 to within the facility 100 of FIG. 3, previously known AGS's described above would not have a way for the AGS to ascertain whether the driver entering or exiting the facility when the driver approaches the gate stands (also known as the combined kiosks 155), and thereby, cannot be sure whether a truck is entering or exiting the facility at the time the truck exits or enters the portals or kiosks. The AGS 100 of the unified gate layout 150 is programmed to receive information to control gate arm actions allowing either ingress or egress for one or more vehicles.

Further, in the unified gate layout 150, the methods implemented for processing an "exception" at the Bi-Directional Portal 140 and gates 156 in the prior art layouts are no longer applicable. To address this issue, a "cleared security-zone" 175 is provided as a result of a modified AGS flow control method as now described with respect to further embodiments of the invention. That is, in one embodiment shown in FIG. 3, a processor is programmed by software for creating a security zone 175 or "vault" so that the gate arms 156 at a kiosk are opened in a timed manner.

Specifically, the gate arms are timed to move trucks out of the kiosk area in an efficient manner. The system monitors if it needs to release trucks to the exit gate or the yard gate, that is, "to yard", or "to exit", modes of operation. The system initializes releasing trucks to exit, and runs this mode for a configurable amount of time, for example, 50 seconds. In the to exit mode, the yard entry gate is closed. As long as a truck is in the safety zone to exit, the main exit gate is opened. During this time, many gate arms open allowing trucks to exit. At any given time during the "to exit" mode, if trucks are not available to exit, and a single truck is ready to enter the yard, the system enters a configuration countdown before switching modes. When the countdown is completed, and the system is ready to switch modes, a second grace period runs. Upon switching modes, the system closes the exit security gate and opens the yard entry gate. Now in the "to yard" mode, the system releases to yard trucks for a configurable amount of time, for example, 50 seconds. As long as trucks are eligible to enter the yard, the system releases the trucks from the kiosk gates. Similarly to the "to exit" mode, as soon as no trucks are set to enter the yard, and a single truck is ready to exit, the system enters a configurable countdown before switching modes.

Referring to the flow chart of FIG. 5, a software method/algorithm (flow chart or pseudo code) is implemented at gates 156 and kiosks 155 that address/correct the challenges above. For example, the entry and exit logic flows for the AGS 100 are modified to accommodate different visit types (i.e., inbound and outbound), and to avoid traffic collisions/jamming.

An AGS gate control system 100 implemented for the unified gate layout 150 in the embodiment of FIG. 3, provides that: when the driver enters the security zone 175, the driver will either have to return to yard via access 167, or exit the facility via access road 127. If the driver exits the security zone 175 and is allowed to exit, then the gate arm 165 at the exit point 167 is raised and the driver is allowed to proceed out of the facility. If, on the other hand, the driver is entering the facility, or is trying to exit but encountered a problem, the AGS controlled exit gate arm 160 will not be raised and the driver must pass through the Return To Yard (RTY) point via AGS controlled exit gate arm 165 as shown in FIG. 3. In one embodiment, a gate arm may or may not be present at the RTY point. If it is present, the gate arm 165 is controlled by the software 204.

It should be understood that the information received from the driver is processed locally and, usually, sent to other systems (which can vary by clients) which validate whether or not the equipment the driver is trying to take out is allowed to exit (e.g., no customs holds), or whether the driver must pay late fees (called demurrage) before the driver can leave the facility, etc.

As typically, a driver returning to the yard poses no security/theft risk, therefore, most facilities opt to have a simple gate arm whereby as a truck drives over a loop, the gate arm simply opens. In an alternative embodiment, software controls when the gate arm closes and opens. In this case, the gate arm 165 at the Return to Yard point would be closed until a truck driver at one of the kiosks encounters a problem. Since the driver cannot be allowed to leave the facility, software initiates closing the exit to street gate arm 160 and raise the RTY gate arm 165. When the driver drives through the RTY point via access way 167, loops in the ground will indicate that the RTY gate arm can close and the gate arm will close, this change in state notifies the software that the driver has returned to the yard and, thus, re-opens the exit to street gate arm 160 and proceeds with normal operations. Alternately, both gate arms 160, 165 may be controlled to be raised automatically by loop detectors or sensors. In one embodiment, tire shredders may be used to prevent any contrary-flow. In another alternative embodiment, there is no gate arm 165 or, it is always opened. The assumption here being that there is no damage done by someone inadvertently returning to the yard if they were leaving, they would just return to the gate stands and exit.

In one further embodiment, logic is used to improve the speed or throughput of a security-lock situation, wherein only one driver (i.e., one vehicle) is allowed to leave the gates at one time, e.g., only one truck is allowed to exit the kiosk area at one time, when that truck has exited the facility, then the next truck is processed, etc. Until the driver and truck are through the exit or RTY points, the next driver(s) is waiting at the gates.

Each truck that needs to depart the kiosk makes a request to the Exit Control System "to exit", or "to enter the yard". The exit control system, when no trucks are in the secure zone, fulfills the request to the oldest kiosk lane, and opens the corresponding gate. At this point, the Exit Control System offers a "Release Granted" to a specific kiosk lane. The kiosk lane accepts the offer and opens its gate. When the truck exits the gate and the arm closes behind the truck, the kiosk gate provides feedback to the exit control system that the release is completed ("release completed") and that there is one or more trucks in the secure zone ("one more truck in the secure zone").

Similarly, the driver at the kiosk may opt to not depart the yard. In this case, an operator may choose to close the kiosk gate arm manually. Further, in this case the kiosk gate provides feedback to the exit control system that the release is completed ("release completed"), and no trucks were added to the security zone ("zero trucks added to the security zone"). The Exit Control System (depending on configuration) allows one or more trucks in the security zone at a time. The Exit Control System monitors the egress of trucks from the security zone, and each time a truck exits the security zone, the Exit Control System decrements the tally. It also monitors trucks returning to the yard, each time decrementing the tally of trucks in a queue of the security zone. When the tally reaches zero, there are no trucks in the security zone. In one alternative, when no trucks are in the zone, the Exit Control System releases the next truck from the gate.

Further, contrary to known prior art systems in which there are distinct portals for entry and exit, and as such there was not a need for regulating traffic by direction (i.e., inbound or outbound), in order to improve performance of the unified gate layout portal operation, the AGS 100 gate control logic 204 processes a group of inbound trucks (or alternatively a group of outbound trucks) at one time, thereby obviating single-mode operation (where only one truck is moving at a time), and criss-crossing trucks in the layout area past the kiosks 155 which could slow down traffic. Thus, in one embodiment, the programmed software at the kiosk employs mitigating logic for "grouping" similar vehicle regarding their direction, i.e., ingress or egress, so that if two drivers, for example, trying to enter the facility are waiting, they, that is the group of vehicles, would be allowed to proceed at the same time before letting a driver waiting to exit into the security zone 175. Thus, the group of vehicles are allowed entry and exit as a singular group.

This mitigating control code provides AGS control such that, when a driver completes their tasks at the kiosk 155, before opening the associated gate arm 156, the software will check to see if there are any other drivers waiting to do the same thing (i.e., either enter or exit the facility), then the software decides to open the gate arm for all those drivers that are similarly exiting or entering the facility. For example, in the case of a driver that has completed their task and is approaching the combined kiosks, once the driver is finished interacting with the kiosk, the software applies logic at the processor 210 of the computer 202, and checks to see if there are other drivers waiting to exit the facility, if there are, the software raises the gate arms for all those waiting to exit while maintaining all others closed.

As a further example, prior to raising gate arms, the AGS mitigating control software checks to see if there are other drivers waiting to be released that have a similar goal (i.e. entry or exit), if so, all gate arms for those individuals will be raised and they'll be allowed to proceed (while the others remain at the gates).

Another method is to always leave the RTY gate arm open (or not put one there in the first place) and traffic is allowed to flow freely. Anyone that needs to exit the facility would be required to scan his/her gate receipt (or other ID card) at a point just before the Exit Gate Arm. This scenario could employ the use of wireless technologies (such as RFID tags) to make the process more automated. The logic employed at gates 155 for this alternate scenario would be to introduce or situate a place (e.g., control booth) just prior to the "exit to street" gate arm 160 where a driver would have to stop for further validation. This would, effectively, create another outbound checkpoint and to verify that the driver is authorized to exit the facility. This flow would be the least preferable, because if a driver is not allowed to exit tries to exit the facility 100, the driver ends up blocking all outbound traffic.

Referring to FIG. 4, with reference to FIG. 3, the AGS facility software, such as executed at the portal and kiosk, provides a method 300 directed to processing a vehicle arriving at the secured facility includes a first step 302 of a truck arriving at the secured facility 99. Step 304 includes the truck driving through the unified Bi-Di portal 140 for initial arrival processing. For example, such processing include invoking high-resolution cameras and imaging devices for taking high-resolution images of the vehicle yielding information including unit numbers, obtaining license plate numbers, obtaining equipment and tire scans, etc. In one embodiment, tire scans of an arriving vehicle may be obtained according to an in-motion tire inspection technique such as described in commonly-owned, co-pending U.S. patent application Ser. No. 13/191,085, which claims priority of U.S. Provisional Patent Application Nos. 61/367,698 and 61/370,311, all of which the disclosures and contents therein are incorporated by reference in their entirety herein. In step 306 the truck arrives at the gate kiosks 155. The driver manually enters information for the visit (e.g., gate mission) in step 308. The computer system 200 checks if the driver's information is correct in step 310. If the driver's information is not correct based on the information provided, the method 300 proceeds to step 312 to check if the driver is at the wrong facility. If the driver is at the wrong facility, the method proceeds to step 314 to close the RTY (return to yard) gate arm 165. The main exit gate arm 160 is opened in step 316, and the gate arm 156 at the kiosks 155 is opened for the driver in step 318. Returning to step 312, if the driver is not at the wrong facility, the method proceeds to step 322 to complete the visit and print a problem or trouble ticket. Returning to step 310, if the driver info is correct, the method proceeds to step 322 to print an entry ticket. In step 324, the method ascertains if there are any other trucks at the gate kiosks, if not, the method proceeds to step 330 to close the main exit gate arm 160 and open the RTY gate arm 165. If there are other trucks at gate kiosks in step 324, the method proceeds to step 326 to ascertain if there are more drivers entering than exiting. If there are more drivers entering than exiting in step 326, the method proceeds to step 328 to determine if there are drivers who have waited too long based on a facility election or selection of a threshold wait time and if not, the method proceeds to step to close the main exit gate arm and open the RTY gate arm. Returning to step 326, if there are not more drivers entering than exiting, the method proceeds to step 332 to determine if there are more drivers entering than exiting. If not, the method proceeds to step 334 to process exiting drivers first, and also proceeds to step 334 from step 328 if exiting drivers have waited too long. Returning to step 332, if there are as many drivers entering as are existing, the method proceeds to step 336 to determine if the driver is first to finish entering information at the kiosk. If the driver is not the first to finish the method proceeds to step 334 form step 336. If the driver is the first to finish, the method proceeds from step 336 to step 330 to close the main exit gate arm and open the RTY gate arm. The method then proceeds to step 338 to open the gate arm for the driver, and the truck and driver proceeds into the yard in step 340.

Referring to FIG. 4, with reference to FIG. 3, the AGS facility software, such as executed at the portal and kiosk, provides a method 400 for processing a vehicle exiting the secured facility 99 including a first step 402 of a truck ready to exit the secured facility 99. Step 404 includes the truck driving through the unified bi-di portal 140 for exit processing. For example, such processing includes, at step 406, the truck arrives at the gate kiosks 156, and the driver scans their ticket and manually enters information in step 408. Step 410 includes ascertaining if the driver should be allowed to exit, e.g., based on the information provided by the driver, and if the driver is not, the method 400 proceeds to step 412 to print an error ticket. Next, the method 400 closes the main exit gate arm 160 and opens the RTY gate arm 165, in step 414. Step 416 includes opening the gate arm for the driver, and the truck returns to the yard in step 418. Step 420 includes the driver switching equipment and/or visits a driver assistance area. Step 422 includes determining if the error is resolved in step 422, and if not, the method returns to step 420, if yes, the method proceeds to step 404. Returning to step 410, if the driver is allowed to exit the method proceeds to step 424 to complete visit (i.e., gate mission) and print a ticket. In step 426, the method 400 determines if any other trucks are at the gate kiosks, if yes, the method continues to step 428 to determine if more drivers existing than entering. If there are more drivers exiting than entering in step 428 the method proceeds to step 436, to determine if the drivers trying to enter have waited for too long based on a selected threshold value. If there are not more drivers exiting than entering in step 428, the method proceeds to step 430 to determine if there are as many drivers entering as exiting. If not, the method proceeds to step 432 to process entering drivers first, and then proceeds to process exiting drivers. If there are as many drivers entering as exiting in step 430, the method proceeds to step 434 to determine if exiting driver is finished first, and if so proceeds to step 438 to close the RTY gate arm and open the main exit gate arm. If the exiting driver is not finished first in step 434, the method returns to step 432. Proceeding from step 438, the gate arm is opened for the driver in step 440, and the truck and driver exit the facility 99 in step 442.

The automatic gate system (AGS) 100 and implemented logic 300 (FIG. 3) and logic 400 (FIG. 4) for a unified gate layout that controls vehicle access to a secure facility 99 and employs a single portal for obtaining and processing information relating to vehicles comprising ingress and egress traffic as a common traffic flow sharing a same access road provides a substantial savings in infrastructure costs, e.g., concrete padding, asphalt, grading, network connectivity, building erection, fixed structures/pedestals, etc., and equipment costs since half the amount of cameras, lights, servers, enclosures, network switches, etc., are needed. These savings, along with the need for less real estate, lends the solution more applicable to smaller facilities (which might otherwise not realize a return on investment for many years). Thus, the unified portal enables small and medium size facilities to gain the safety and security aspects of an automated gate system.

While the present invention has been particularly shown and described with respect to preferred embodiments thereof, it will be understood by those skilled in the art that changes in forms and details may be made without departing from the spirit and scope of the present application. It is therefore intended that the present invention not be limited to the exact forms and details described and illustrated herein, but falls within the scope of the appended claims.

What is claimed is:

1. An automated gate system (AGS) for a unified gate layout, comprising:

a single portal receiving and processing vehicles comprising ingress and egress traffic as a common traffic flow moving in a same direction sharing a same access road, the single portal obtaining and processing information relating to vehicles passing therethrough;

a multi-lane gated sub-system having associated kiosks providing interface for obtaining vehicles and driver related information and each of the kiosks having a combined inbound/outbound gate for controlling ingress and egress movement of vehicles of the common traffic flow moving in a same direction into and out of a controlled access facility; and a computer system for receiving signals from the portal and the kiosks, the signals representing a status of the vehicles alone or in combination with driver information and processing the signals to control operations of one or more gates traversing ingress and egress routes for the controlled access facility, the computer system including a program embodied on a non-transitory computer storage medium for controlling gate operation of each of the gates and thereby controlling both ingress and egress routes and controlling both ingress and egress movement of the vehicles to and from the controlled access facility, thereby the computer system receives information from the single portal and controls the gate operations of each of the gates in the multi-lane gated subsystem.

2. The system of claim 1, wherein the common traffic flow comprises: merged ingress traffic received from an access road enabling entry of vehicles from a public access; and egress traffic returning from a controlled access area within the facility.

3. The system of claim 1, wherein one or more of the signals operate a gate at the single portal for processing inbound or outbound traffic.

4. The system of claim 1, wherein the gates include gate arms controlled by the program, or the gate arms are raised automatically by activation of loop detectors or sensors by the vehicles.

5. The system of claim 1, further comprising a security-lock situation which employs logic used to allow only one vehicle at a time to pass through an exit gate.

6. The system of claim 5, wherein the security-lock situation uses the logic to increase throughput speed of the vehicle during the security-lock situation at the exit gate.

7. The system of claim 1, wherein the computer system uses mitigating logic to identify a group of vehicles ready for ingress or egress from or into the controlled access facility, and the mitigating logic allows the group of vehicles to enter or exit as a singular entity while delaying other vehicles ingress or egress.

8. A method for automating a gate system (AGS) for a unified gate layout, comprising:

receiving and processing vehicles using a single portal comprising ingress and egress traffic as a common traffic flow moving in a same direction sharing a same access road;

obtaining and processing information relating to vehicles passing through the single portal;

controlling ingress and egress movement of vehicles of the common traffic flow moving in a same direction into and out of a controlled access facility using a multi-lane gated sub-system having associated kiosks providing interface for obtaining vehicles and driver related information wherein each of the kiosks include a combined inbound/outbound gate; and receiving signals from the portal and the kiosks using a computer system including a program embodied on a non-transitory computer storage medium, wherein the signals represent a status of the vehicles alone or in combination with driver information;

processing the signals to control operations of one or more gates traversing ingress and egress routes for the controlled access facility, wherein controlling gate operation of each of the gates thereby controls both ingress and egress routes and controls both ingress and egress movement of the vehicles to and from the controlled access facility, thereby the computer system receives information from the single portal and controls the gate operations of each of the gates in the multi-lane gated sub-system.

9. The method of claim 8, wherein the common traffic flow includes: merging ingress traffic received from an access road which enables entry of vehicles from a public access; and returning egress traffic from a controlled access area within the facility.

10. The method of claim 8, further comprising:

operating a gate at the single portal for processing inbound or outbound traffic using one or more of the signals.

11. The method of claim 8, further comprising:

automatically activating gate arms of the gates controlled by the program, or automatically activating the gate arms using loop detectors or sensors by the vehicles.

12. The method of claim 8, allowing only one vehicle at a time to pass through an exit gate during a security-lock situation.

13. The method of claim 12, further comprising increasing throughput speed of the vehicle during the security-lock situation at the exit gate using logic at the exit gate or at the computer system.

14. The method of claim 8, further comprising:

identifying a group of vehicles ready for ingress or egress from or into the controlled access facility; and allowing the group of vehicles to enter or exit as a singular entity while delaying other vehicles ingress or egress.

15. A computer program product for automating a gate system (AGS) with a unified gate layout, the computer program product including a computer program or program code embodied on a non transitory computer readable medium for causing a processor of a computer to initiate the steps of:

receiving and processing vehicles using a single portal comprising ingress and egress traffic as a common traffic flow moving in a same direction sharing a same access road; obtaining and processing information relating to vehicles passing through the single portal;

controlling ingress and egress movement of vehicles of the common traffic flow moving in a same direction into and out of a controlled access facility using a multi-lane gated sub-system having associated kiosks providing interface for obtaining vehicles and driver related information wherein each of the kiosks include a combined inbound/outbound gate; and receiving signals from the portal and the kiosks using a computer system including a program embodied on a non-transitory computer storage medium, wherein the signals represent a status of the vehicles alone or in combination with driver information;

processing the signals to control operations of one or more gates traversing ingress and egress routes for the controlled access facility, wherein controlling gate operation of each of the gates thereby controls both ingress and egress routes and controls both ingress and egress movement of the vehicles to and from the controlled access facility, thereby the computer system receives information from the single portal and controls the gate operations of each of the gates in the multi-lane gated sub-system.

16. The computer program product of claim 15, wherein the common traffic flow includes: merging ingress traffic received from an access road which enables entry of vehicles from a public access; and returning egress traffic from a controlled access area within the facility.

17. The computer program product of claim 15, further comprising:

operating a gate at the single portal for processing inbound or outbound traffic using one or more of the signals.

18. The computer program product of claim 15, further comprising:

automatically activating gate arms of the gates controlled by the program, or automatically activating the gate arms using loop detectors or sensors by the vehicles.

19. The computer program product of claim 15, allowing only one vehicle at a time to pass through an exit gate during a security-lock situation.

20. The computer program product of claim 19, further comprising increasing throughput speed of the vehicle during the security-lock situation at the exit gate using logic at the exit gate or at the computer system.

21. The computer program product of claim 15, further comprising:

identifying a group of vehicles ready for ingress or egress from or into the controlled access facility; and allowing the group of vehicles to enter or exit as a singular entity while delaying other vehicles ingress or egress.

* * * * *